United States Patent [19]

McGinnis

[11] Patent Number: 4,991,367

[45] Date of Patent: Feb. 12, 1991

[54] APPARATUS AND METHOD FOR REINFORCING A WOODEN POLE

[76] Inventor: Henry J. McGinnis, P.O. Box 7256, Fort Worth, Tex. 76111

[21] Appl. No.: 405,569

[22] Filed: Sep. 11, 1989

[51] Int. Cl.[5] ..... E02D 5/74

[52] U.S. Cl. ..... 52/170

[58] Field of Search ..... 52/170, 169.13, 741, 52/742

[56] References Cited

U.S. PATENT DOCUMENTS

| | | | |
|---|---|---|---|
| 646,970 | 4/1900 | Francis . | |
| 1,726,371 | 8/1929 | Spring | 52/170 |
| 1,784,770 | 12/1930 | Wiley . | |
| 1,995,874 | 3/1935 | Van de Mark | 52/728 |
| 2,026,157 | 12/1935 | Beecher | 52/170 |
| 3,193,252 | 7/1965 | Barrett . | |
| 3,320,714 | 5/1967 | Barrett . | |
| 3,738,072 | 6/1973 | Adrian . | |
| 3,847,231 | 11/1974 | Warjone . | |
| 4,756,130 | 7/1988 | Burtelson . | |

*Primary Examiner*—John E. Murtagh

*Attorney, Agent, or Firm*—James E. Bradley

[57] ABSTRACT

A method and apparatus are used for reinforcing a wooden utility pole. A plurality of longitudinal braces are spaced circumferentially around the pole in a deteriorated area. The braces are connected together with links. The widths of the links increase in a downward direction so that the brace assembly will match the taper of the pole. After the brace assembly has been assembled, the assembly is moved downward on the pole to wedge it tightly against the pole.

12 Claims, 2 Drawing Sheets

APPARATUS AND METHOD FOR REINFORCING A WOODEN POLE

BACKGROUND OF THE INVENTION

1. Field of the Invention

This invention relates in general to a means for reinforcing a wooden utility line pole, and in particular to a brace assembly that encircles and supports the pole in a deteriorated area of the pole.

2. Description of the Prior Art

There are millions of utility poles in existence. These poles carry electrical and telephone lines. The poles are made from a trunk of a tree and treated to resist deterioration. Nevertheless, deterioration does occur. The most likely spot for deterioration is at the ground level.

When the pole deteriorates sufficiently, a danger exists that it could blow over in a high wind. Replacing these wooden poles is expensive. There are various methods in the use and shown in the patented art for repairing a deteriorated area. In some of the methods a grout such as a high-density polyurethane is poured around the pole in the deteriorated area. This requires special equipment and the material cost is expensive. Several patents propose metal braces for placement on the pole to provide additional bending strength. The braces rely on clamps, which can loosen with movement of the pole.

SUMMARY OF THE INVENTION

In this invention, a plurality of longitudinal braces are spaced circumferentially around the pole. These braces are linked together by linking members. The linking members are sized to provide a tapered configuration to the brace assembly. This brace configuration will match the natural taper of the pole. After assembly, the braces are wedged tightly against the pole to provide the reinforcement.

In the preferred embodiment, the wedging is handled by hydraulic cylinders. A ring encircles the pole and rests on top of the assembled braces. The hydraulic cylinders apply a downward force to the ring to push the braces down in unison. Once wedged in place, the ring and hydraulic cylinders can be removed. If desired, the braces can be encased in a grout.

DETAILED DESCRIPTION OF THE INVENTION

Figure 1:
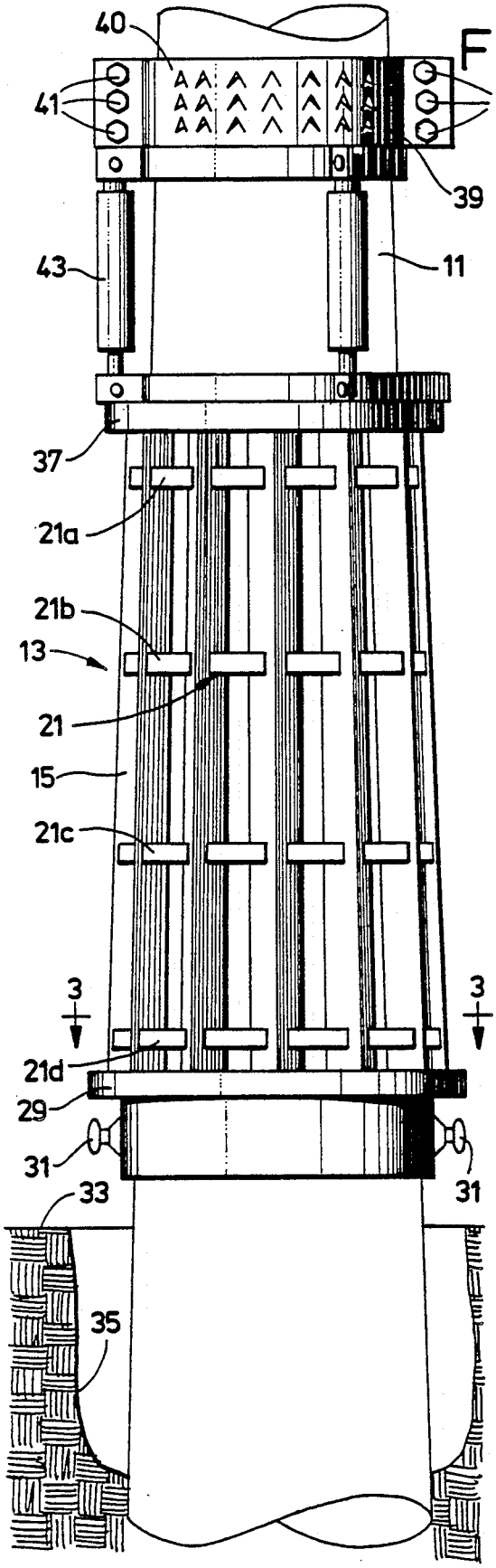
FIG. 1 is a side view of an apparatus for reinforcing poles constructed in accordance with this invention and shown prior to wedging the bracing assembly in place.
Figure 3:
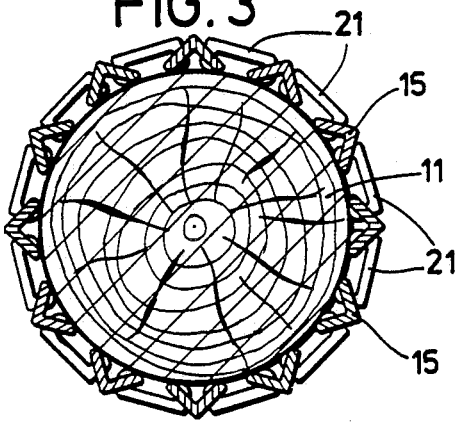
FIG. 3 is a cross sectional view of the brace assembly of FIG.1, taken along the line 3—3 of FIG. 1.

Referring to FIG. 1, pole 11 is a wooden utility pole that has been previously installed. Pole 11 has an exterior surface which has a taper. The taper is typically results in the diameter increasing in downward direction about ⅛ every foot. Consequently, the exterior surface is slightly conical.

Figure 4:
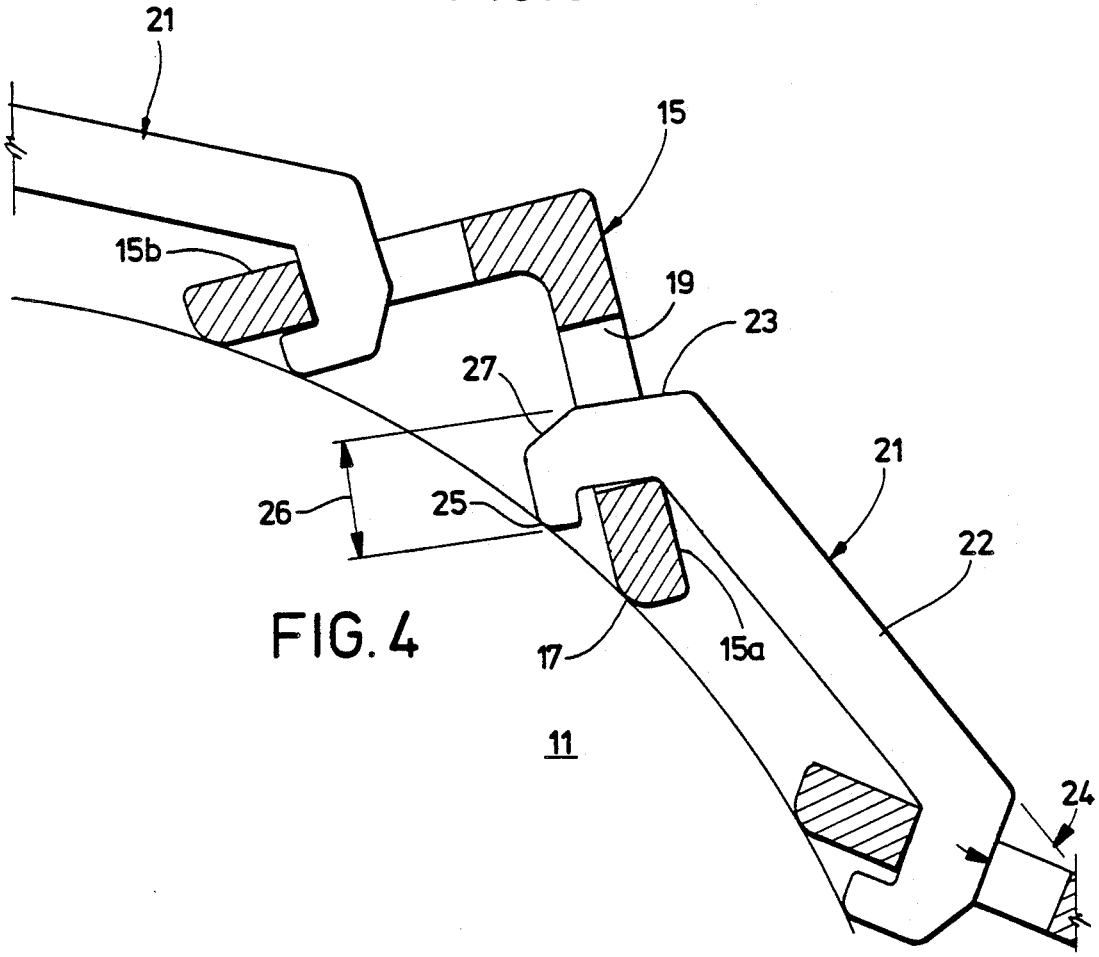
FIG. 4 is an enlarged sectional view of a portion of the brace assembly of FIG. 1.

A brace assembly 13 can be used to support the pole 11 in a deteriorated area. Brace assembly 13 is made up of a plurality of longitudinal braces 15. Braces 15 will extend longitudinally along the length of the pole 11, generally parallel to the axis of the pole 11. As shown in FIG. 4, each brace 15 is an angle member having two portions 15*a* and 15*b*. The portions 15*a* and 15*b* intersect each other at a 90 degree angle. This results in two free edges 17. Edges 17 will be positioned in contact with the exterior of pole 11. Edges 17 are rounded so that they will not gouge or cut into the exterior of pole 11 when the braces 15 are wedged in place. The rounded edges 17, rather, apply a compressive force to the exterior of pole 11.

Each brace 15 has a plurality of apertures 19. Apertures 19 extend through each portion 15*a* and 15*b*. Each aperture 19 is elongated in a longitudinal direction. As shown in FIG. 1, the apertures 19 are spaced apart from each other along the length of the brace 15. Typically, the apertures 19 will be spaced apart about 4 inches from each other. If desired, double rows of apertures 19 could be placed at the top and at the bottom of the brace assembly 13.

A plurality of links 21 connect the braces 15 together. As shown in FIG. 1, a set of links 21 will be used for each of the rows of apertures 19. For the particular brace assembly 13 of FIG. 1, there will be four sets of links 21*a*, 21*b*, 21*c* and 21*d*, spaced apart along the lengths of the braces 15.

Referring again to FIG. 4, each link 21 is a solid integral steel member. Each link 21 has a central body 22. A leg 23 extends from each end of the body 22. Each leg 23 extends from body 22 at an angle 24 of about 60 degrees. A lug 25 extends inward from each leg 23. Lug 25 is a short member that extends inward at a 90 degree angle relative to the leg 23. The axes of the lugs 25 intersect each other at a 120 degree angle.

The thickness of the body 22 is the same as the thickness of the legs 23, and about the same thickness as the braces 15. This thickness is less than the transverse dimension of the aperture 19. The dimension 26 from the edge of lug 25 to the outer side of leg 23 is less than the transverse dimension of the aperture 19. This enables the lug 25 to be inserted directly into the aperture 19 when the brace 15 is placed against the pole 11. The link 21 does not have to be angled relative to the brace 15. A bevelled portion 27 will be located on each leg 23 on the inner side.

The body portion 22 (FIG. 4) of each link 21 may differ for each set 21*a*, 21*b*, 21*c* and 21*d* (FIG. 1). The other dimensions will remain the same. The widths of the body 22 will increase in a downward direction along the braces 15, so that the brace assembly 13 will have the same taper as the natural taper of the pole 11.

When assembling the brace assembly 13, a shelf clamp 29 will be used. Shelf clamp 29 has two halves that may be placed around the pole 11 and clamped in place. Handles 31 will be rotated to clamp the shelf clamp 29 to the pole 11. Typically, the shelf clamp 29 will be placed from about 2 to 5 feet above the surface of ground 33. An annular hole 35 will be dug to a certain depth below the surface of ground 33 and surrounding pole 11.

A ring 37 will be placed on top of the braces 15 when the brace assembly 13 is ready to be wedged in place. Ring 37 is also of two halves and can be bolted together. A reaction clamp 39 will be rigidly clamped to the pole 11 a measured distance above the ring 37. The reaction clamp 39 has teeth 40 which are used to bite into the surface of the pole 11. It will be bolted in place by bolts 41 and tightened.

A plurality of hydraulic cylinders 43, typically three, will connect the reaction clamp 39 with the ring 37. A source of hydraulic fluid pressure will be used to supply hydraulic fluid under pressure to the hydraulic cylinders 43.

In operation, first a hole 35 will be dug around the pole 11 to a selected depth. The worker will measure the pole diameter at several places in the deteriorated section. Preferably, he will communicate these dimensions to a central location, either by telephone or by a portable facsimile machine. The central location will then compute the degree of taper. The central location will also compute what size of links 21 that he needs to use. The central location will communicate this information to the worker.

The worker then will place the shelf clamp 29 on at the desired elevation above the surface of ground 33. He will begin placing the braces 15 on the shelf clamp 29. If necessary, he may use an elastic strap (not shown) to temporarily hold them in place. He will interconnect the braces 15 with the links 21*a*, 21*b*, 21*c* and 21*d*. He inserts the links 21 into the apertures 19. The brace assembly 13 will have a tapered configuration and will be fitting loosely around the pole 11. The tapered configuration will be at the same degree of taper as the exterior pole 11. Initially, the diameter of the brace assembly 13 at the shelf clamp 29 will be slightly larger than the diameter of pole 11 at that point. A clearance between the brace assembly 13 and the pole 11 will exist throughout the length of the brace assembly 13.

When the brace assembly 13 has been assembled, he then removes the shelf clamp 29. The brace assembly 13 will drop downward under its own weight. Brace assembly 13 will drop until the diameter of the brace assembly 13 along its length becomes the same or less than the pole 11. The brace assembly 13 will then stop downward movement because of the engagement of the edges 17 with the pole 11. He places the ring 37 on top on the upper ends of the braces 15. He then clamps the reaction clamp 39 tightly around the pole 11 above the ring 37. The hydraulic cylinders 43 will interconnect the reaction clamp 39 with the ring 37.

He then applies hydraulic pressure to the hydraulic cylinders 43. The hydraulic cylinders 43 will force the entire brace assembly 13 downward in unison until a selected hydraulic pressure is reached. As it moves downward, the edges 17 (FIG. 4) will compress the exterior of the wooden pole 11. This occurs because the diameter of the brace assembly 13 will become less than the outer diameter of the pole 11 as the brace assembly 13 moves downward. The compression of the edges 17 occurs along the entire length of the braces 15 because the taper of the brace assembly 13 will be the same taper as the exterior of pole 11. It may be necessary to position the reaction clamp 39 at a lower point and stroke the hydraulic cylinders 43 again in order to reach the desired hydraulic pressure.

Once the desired hydraulic pressure has been reached, the worker removes the reaction clamp 39, ring 37 and hydraulic cylinders 43. The exterior of pole 11 will be exposed at various points along the brace assembly 13 between the links 21*a*, 21*b*, 21*c* and 21*d*. These exposed spaces may be used to inject treating fluids at this time or at a later date. The exposed spaces may also allow visual inspection to be made of the deteriorated area later.

Figure 2:
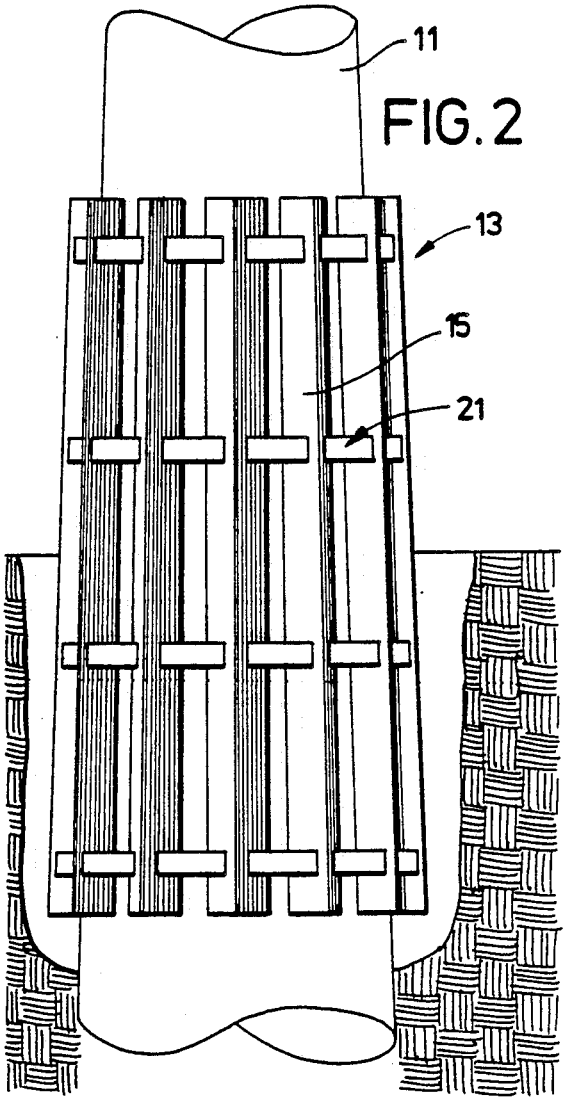
FIG. 2 is a side view of the brace assembly of FIG. 1, with the brace assembly shown wedged in place.
Figure 5:
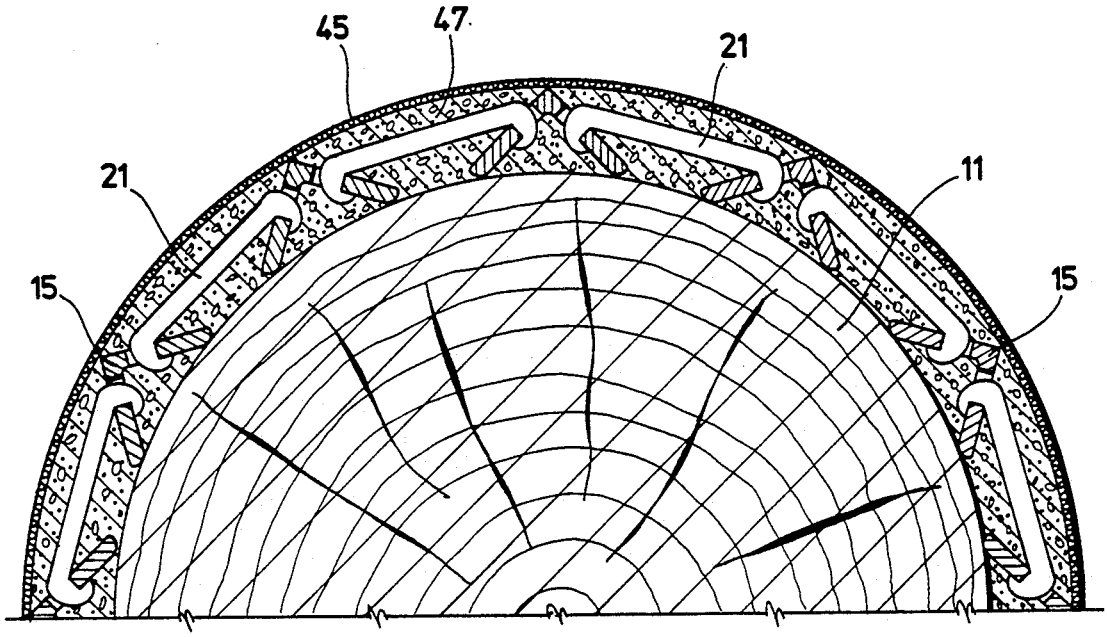
FIG. 5 is a sectional view of a portion of the brace assembly of FIG. 1, and shown encased in a grout.

On the other hand, some may prefer to enclose the deteriorated area with a grout or other filler. If so, as shown in FIG. 5, a sleeve 45 will be placed around the brace assembly 13 after it is wedged in place as shown in FIG. 2. Sleeve 45 may be sheet metal or other appropriate material. Grout 47 will be poured or pumped down the sleeve 45 to encase the brace assembly 13.

The invention has significant advantages. The brace assembly will provide reinforcement to a pole. It is inexpensive, made up of simple components. Only one or two workers are necessary for installing it. No large equipment will be needed. It could even be used to raise the height of a pole by cutting the pole in half, lifting the pole, then inserting a stub between the ends of the pole before installing the brace.

While the invention has been shown only in two of its forms, it should be apparent to those skilled in the art that it is not so limited but is susceptible to various changes without departing from the scope of the invention.

I claim:

1. An apparatus for reinforcing a wooden pole, the pole having a longitudinal axis and a tapered exterior, comprising:

at least three longitudinal braces adapted to be spaced circumferentially around the pole;

connection means for connecting the longitudinal braces together into a tapered configuration having substantially the same degree of taper as the pole; and wedge means for moving the braces downward in unison while connected together by the connection means, for wedging the longitudinal braces into the pole.

2. The apparatus according to claim 1 wherein the longitudinal braces each have an angular configuration in transverse cross-section with two portions intersecting each other, each portion having a edge adapted to engage the pole when the wedge means wedges the longitudinal braces into the pole.

3. An apparatus for reinforcing a wooden pole, the pole having a longitudinal axis and a tapered exterior, comprising:

at least three longitudinal braces adapted to be spaced circumferentially around the pole;

a plurality of linking members, each linking member having a hook-shaped lug on opposite ends;

engagement means spaced along the longitudinal length of each brace for receiving one end of each of the lugs for connecting the longitudinal braces together, the widths of the linking members from one lug to the other lug being selected to provide for the longitudinal braces when assembled a tapered configuration having substantially the same degree of taper as the pole, the engagement means comprising a plurality of apertures into which the lugs hook; and wedge means for moving the longitudinal braces downward in unison while connected together with the linking members for wedging the longitudinal braces against the exterior of the pole.

4. The apparatus according to claim 3 wherein each of the linking members is a solid integral member having a fixed width from one lug to the other lug.

5. The apparatus according to claim 3 wherein the wedge means comprises:

a ring adapted to be placed on the upper ends of the longitudinal braces encircling the pole;

a reaction clamp;

means for clamping the reaction clamp rigidly to the pole above the ring; and a plurality of hydraulic cylinders connected between the reaction clamp and the ring for moving the ring and longitudinal braces downward when actuated.

6. The apparatus according to claim 5 wherein the wedge means further comprises:

a shelf clamp; and means for mounting the shelf clamp around the pole below the longitudinal braces for supporting the longitudinal braces as they are connected together with the linking members and for removing the shelf clamp from the pole once the longitudinal braces are connected together and prior to actuating the hydraulic cylinders.

7. An apparatus for reinforcing a wooden pole, the pole having a longitudinal axis and a tapered exterior, comprising:

a plurality of longitudinal braces adapted to be spaced a around the pole, each longitudinal brace being angular in cross-section, having two portions which intersect each other at an angle, each portion having an edge adapted to engage the pole;

a plurality of linking members, each linking member having a lug on opposite ends;

a plurality of apertures spaced along the longitudinal length of each brace, each aperture receiving one of the lugs for connecting the longitudinal braces together, the widths of the linking members from one lug to the other lug increasing in a downward direction along the longitudinal braces to provide for the longitudinal braces a tapered configuration having substantially the same degree of taper as the pole;

a ring adapted to be placed on the upper ends of the longitudinal braces encircling the pole;

a reaction clamp adapted to be placed above the ring rigidly to the pole;

a plurality of hydraulic cylinders connected between the clamp and the ring for moving the ring and longitudinal braces downward when actuated; and a shelf clamp adapted to be placed around the pole below the longitudinal braces for supporting the longitudinal braces as they are connected together with the linking members, the shelf clamp being removable from the pole once the longitudinal braces are connected together and prior to actuating the hydraulic cylinders.

8. The apparatus according to claim 7 wherein clearances exist between the longitudinal braces once wedged in place.

9. A method of reinforcing a wooden pole, the pole having a longitudinal axis and a tapered exterior, comprising:

placing at least three longitudinal braces circumferentially around the pole;

connecting the longitudinal braces together in a tapered configuration having substantially the same degree of taper as the pole; then moving the longitudinal braces downward in unison while connected together, thereby wedging the longitudinal braces against the pole.

10. A method of reinforcing a wooden pole, the pole having a longitudinal axis and a tapered exterior, comprising:

clamping a shelf clamp around the pole;

placing a plurality of longitudinal braces on the shelf clamp so that they are spaced circumferentially around the pole;

connecting the longitudinal braces together in a tapered configuration having substantially the same degree of taper as the pole;

removing the shelf clamp and allowing the longitudinal braces to drop downward in unison until the longitudinal braces wedge against the pole;

placing a ring around the pole on the upper ends of the longitudinal braces;

clamping a reaction clamp above the ring;

connecting a plurality of hydraulic cylinders between the reaction clamp and the ring; then actuating the hydraulic cylinders to move the braces downward, further wedging the longitudinal braces against the pole.

11. The method according to claim 10, further comprising:

removing the ring, the reaction clamp and the hydraulic cylinders after the longitudinal braces are wedged into the pole.

12. The method according to claim 11, further comprising:

placing a sleeve around the longitudinal braces after the ring, the reaction clamp and the hydraulic cylinders are removed; then filling the sleeve with a filler.

* * * * *